US007530549B1

(12) United States Patent
Hansen et al.

(10) Patent No.: US 7,530,549 B1
(45) Date of Patent: May 12, 2009

(54) ARTICULATING BALCONY RAILING SYSTEM

(76) Inventors: Tracy C. Hansen, 4860 NW. Shute Rd., Hillsboro, OR (US) 97124; Lucas Gregg, 4860 NW. Shute Rd., Hillsboro, OR (US) 97124

( * ) Notice: Subject to any disclaimer, the term of this patent is extended or adjusted under 35 U.S.C. 154(b) by 6 days.

(21) Appl. No.: 11/699,533

(22) Filed: Jan. 29, 2007

(51) Int. Cl.
*E04H 17/14* (2006.01)

(52) U.S. Cl. ..... 256/60; 256/27

(58) Field of Classification Search ..... 256/65.02, 256/65.03, 65.07, 67, 24, 19, 21, 59, 60, 256/26, 27, 65.04; 403/170, 172–174, 178; 52/300; 160/135
See application file for complete search history.

(56) References Cited

U.S. PATENT DOCUMENTS

| | | | | | |
|---|---|---|---|---|---|
| 1,098,503 | A * | 6/1914 | Johnson | 256/26 |
| 2,011,528 | A * | 8/1935 | Seay | 256/26 |
| 2,983,071 | A * | 5/1961 | Oliver | 446/92 |
| 3,874,132 | A * | 4/1975 | Mendelow et al. | 52/71 |
| 4,036,371 | A * | 7/1977 | Michel | 211/182 |
| 4,214,409 | A * | 7/1980 | Gebhardt et al. | 52/127.12 |
| 4,361,314 | A * | 11/1982 | Ohlson | 256/65.02 |
| 4,623,128 | A * | 11/1986 | Dutch et al. | 256/65.08 |
| 4,920,717 | A * | 5/1990 | Hooper, Jr. | 52/204.597 |
| 5,584,610 | A * | 12/1996 | Simpson et al. | 405/281 |
| 5,649,688 | A * | 7/1997 | Baker | 256/21 |
| 6,412,122 | B1 * | 7/2002 | Foy et al. | 4/506 |
| 6,698,725 | B1 * | 3/2004 | Berry | 256/11 |
| 6,761,641 | B2 * | 7/2004 | Martin et al. | 472/92 |
| 7,024,834 | B2 * | 4/2006 | Gimpel et al. | 52/655.1 |
| RE39,842 | E * | 9/2007 | Purvis et al. | 256/67 |
| 2003/0234391 | A1 * | 12/2003 | Sheppard et al. | 256/67 |
| 2004/0245513 | A1 * | 12/2004 | Izumi | 256/65.02 |
| 2006/0006372 | A1 * | 1/2006 | Forbis et al. | 256/59 |
| 2007/0029534 | A1 * | 2/2007 | Adderton | 256/24 |
| 2008/0087874 | A1 * | 4/2008 | Ebeling | 256/67 |

FOREIGN PATENT DOCUMENTS

WO WO 2005028776 A1 * 3/2005

* cited by examiner

*Primary Examiner*—Victor MacArthur
*Assistant Examiner*—Joshua T Kennedy
(74) *Attorney, Agent, or Firm*—Michael J. Tavella

(57) ABSTRACT

A curved railing system that does not use curved infill panels and has a continuous curved top rail. It uses a series of posts that follow the desired curve. The posts have a bottom rail and space to hold infill panels that may be glass, solid panels, perforated panels, vertical pickets, or cables. All of these infill panels are straight panels that are not curved. A special post cap is installed on the posts. The post cap has pivoting articulating brackets that are used to support and align glass channels. The top rail is a continuous length of railing that matches the desired curve. The top rail is placed over the posts and glass channels. In this way, the entire assembly produces a curved rail design at a lower cost and with less labor than a conventional curved rail.

20 Claims, 13 Drawing Sheets

ARTICULATING BALCONY RAILING SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to curved railing systems and particularly to curved railing systems that use segmented infill panels.

2. Description of the Prior Art

Many buildings have decks, porches and balconies (note the works "deck" herein shall include to decks, porches, and balconies) added to them. They provide useful outdoor space and add value to the building from both a utility perspective as well as an aesthetic perspective. One of the more aesthetically pleasing balcony configurations are those that contain one or more radiused or curved sides. While aesthetically pleasing, however, balconies with curved sides can present difficult challenges for those designing and installing the associated railing system.

Railing systems are used to provide safety on an elevated deck, as well as providing an aesthetically pleasing element of the overall design. The problem with curved railings is obtaining infill panels (such as glass) that match the curve. Curved glass is expensive. Moreover, fitting the segmented top rail to the construction adds labor cost because the top rail must be custom fitted in the field by making precise miter cuts to join the top rail segments together. It requires considerable skill on the part of the installer to make multiple precision miter cuts. Otherwise, the entire appearance of the railing will be negatively impacted. Because curved railing involve considerably higher costs and require a higher level of skilled labor to install, they are generally limited to high budget projects. Moreover, the use of curved decks is also limited for the same reason.

BRIEF DESCRIPTION OF THE INVENTION

The instant invention overcomes these difficulties. It is a railing system that accommodates balcony applications with one or more curved sides, yet does not use curved infill panels while utilizing a continuous curved top rail that eliminates the need for miter cuts in the installation. It uses a series of vertical posts that follow the line of a desired curve. The posts have a bottom rail and space to hold infill panels that may be glass, solid panels of metals or plastics, perforated metal or plastic panels, vertical pickets, or cables. All of these infill panels are straight panels that are not curved. A special post cap is installed on the vertical posts. The post cap has pivoting articulating brackets that are used to support and align glass channels. The top rail is a continuous length of railing that matches the desired curve. The top rail is placed over the vertical posts and glass channels. In this way, the entire assembly produces a curved rail design at a lower cost and with less labor than a conventional curved rail.

DETAILED DESCRIPTION OF THE INVENTION

Figure 1:
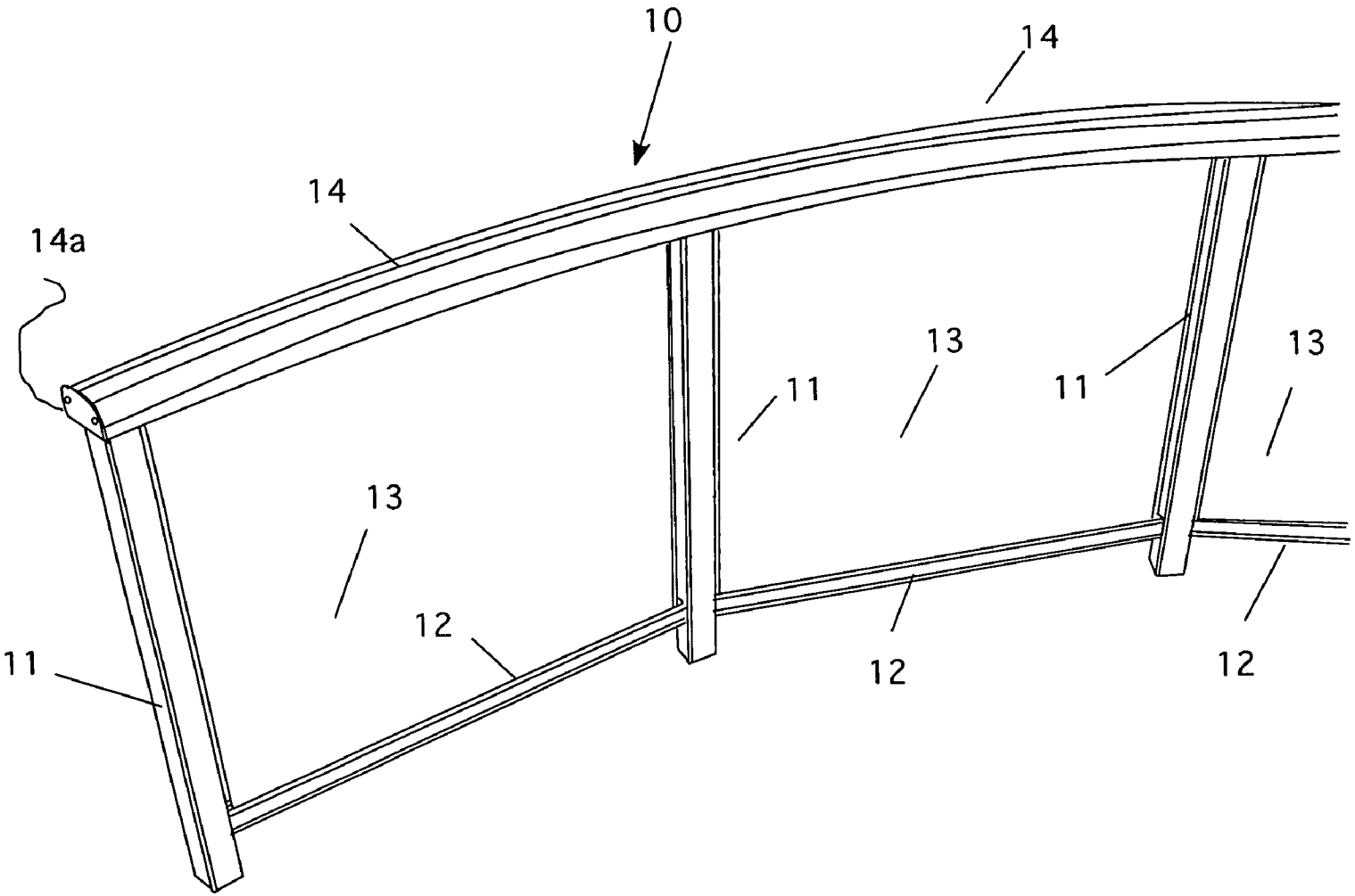
FIG. 1 is perspective view of a section of curved rail according to the disclosed invention.

Referring now to FIG. 1, a perspective view of a section of curved rail according to the disclosed invention is shown. The main components of the railing system 10 are a series of vertical post assemblies 11, a length of bottom rail 12 that runs between the vertical post assemblies 11, a number of infill panels 13 that fit between the vertical post assemblies 11 and rest on the bottom rail sections 12, and a top rail 14 that sit atop the vertical post assemblies and the infill panels. At the end of the top rail 14 is an end cover 14*a* as shown. The infill panels may be glass, solid panels of metal, perforated metal panels, vertical pickets, or cables. See FIGS. 20-22. shows a curved rail at a nominal ten-foot radius. The vertical post assemblies 11 are placed 42 inches on center. Note that infill panels 13 are straight and run diagonally under the rail. Of course, for other radii or curved rail, the dimensions will change accordingly. For example, placement of the vertical post assemblies must be done to keep the infill panels straight under the curved rail. This can be done easily, by first laying out the desired radius for the curve (shown in the dashed lines) and then placing the posts at the spacing needed to keep the infill panels straight and under the rail. Of course, there maybe radii of curves that are too sharp to enable the infill panels and vertical post assemblies to fit under the rail. However, for most general applications, such problems can be eliminated by taking care in the initial design to ensure a useable radius for the rail.

This figure also shows two articulating bracket assemblies 20 and an end assembly 21. The two articulating bracket assemblies are the heart of the system and are discussed in detail below.

Figure 3:
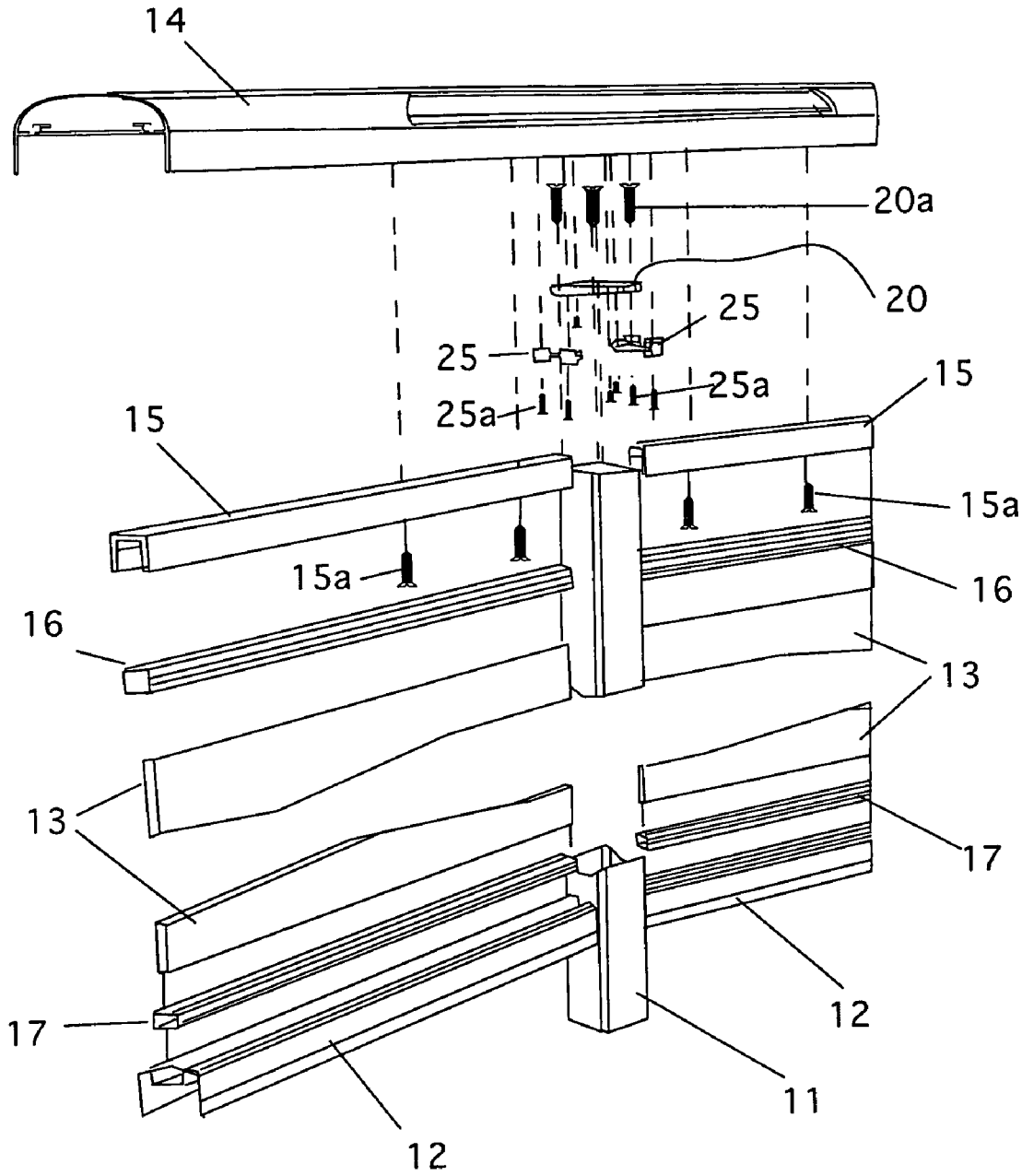
FIG. 3 is a partially exploded view of a section of the curved rail.

FIG. 3 is a partially exploded view of a section of the curved rail. At the top of the railing, is the curved top rail 14. This is normally made of aluminum, although other materials can be incorporated as well. It has a large flat area to allow the diagonal positioning of the glass channel 15. The glass channel 15 is a length of straight aluminum channel that is attached to the top rail 14 with screws 15*a*. Note that, although this element is designated as a "glass channel" its use is not limited to glass infill panels, as is discussed above. A length of vinyl insert 16 is placed within the glass although this element is designated as a "glass channel" its use is not limited to glass infill panels, as is discussed above. A length of vinyl insert 16 is placed within the glass channel 15 to secure and protect the infill panels 13, which may be glass, metal or plastic. At the bottom of the infill panels 13 is another length of vinyl insert 17 to secure and protect the infill panels. Finally, the bottom rail 12 is attached to the posts, as discussed above. Note that the bottom rail is normally mitered at the posts to ensure a clean fit for the rails.

Figure 2:
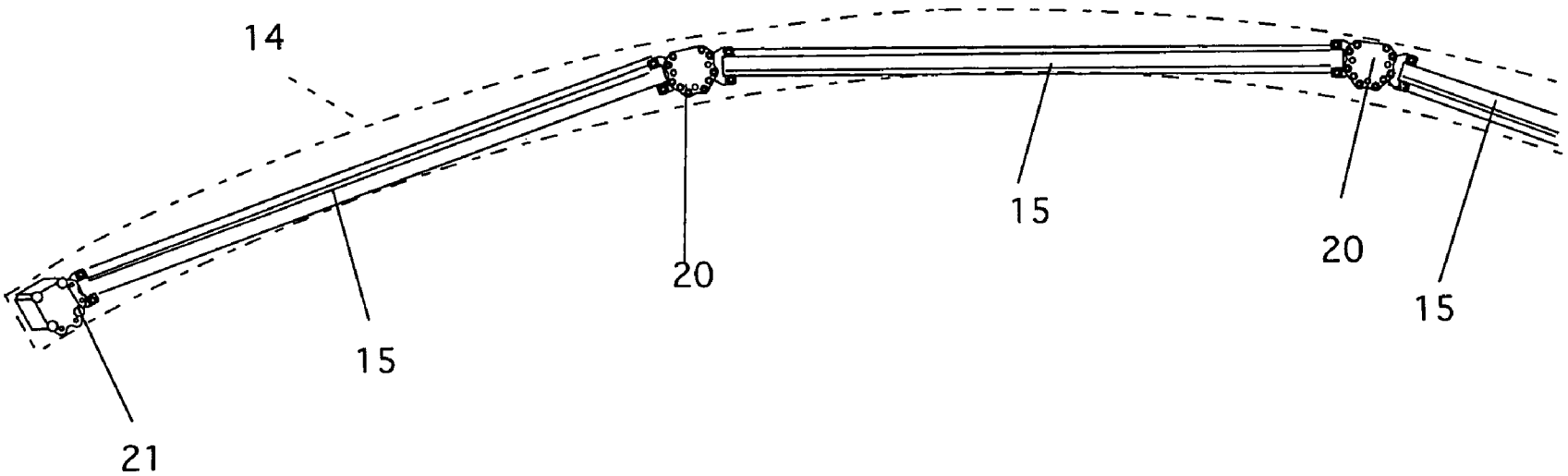
FIG. 2 is a top detail view of the curved rail system, showing the outline of the curved top rail and the position of the posts and infill panels beneath it.

FIG. 3 also shows the some details of the assembly of the post cap. The post cap 20 is secured to the vertical post with screws 20*a*. Articulating mounting brackets 25 help to secure the glass channels to the post cap. For a center run, two articulating mounting brackets 25 are normally used. The articulating mounting brackets 25 are pivotably secured to the post caps, as discussed below. This allows the articulating mounting brackets 25 to be positioned properly to align the glass channels 15 with the curve of the top rail (see FIG. 2). Once the base railing sections are all in place and secure, the articulating mounting brackets 25 strengthen the glass channels. Moreover, the adjustability of the articulating mounting brackets 25 aids in the overall installation as the alignment of the components is greatly simplified.

Figure 4:
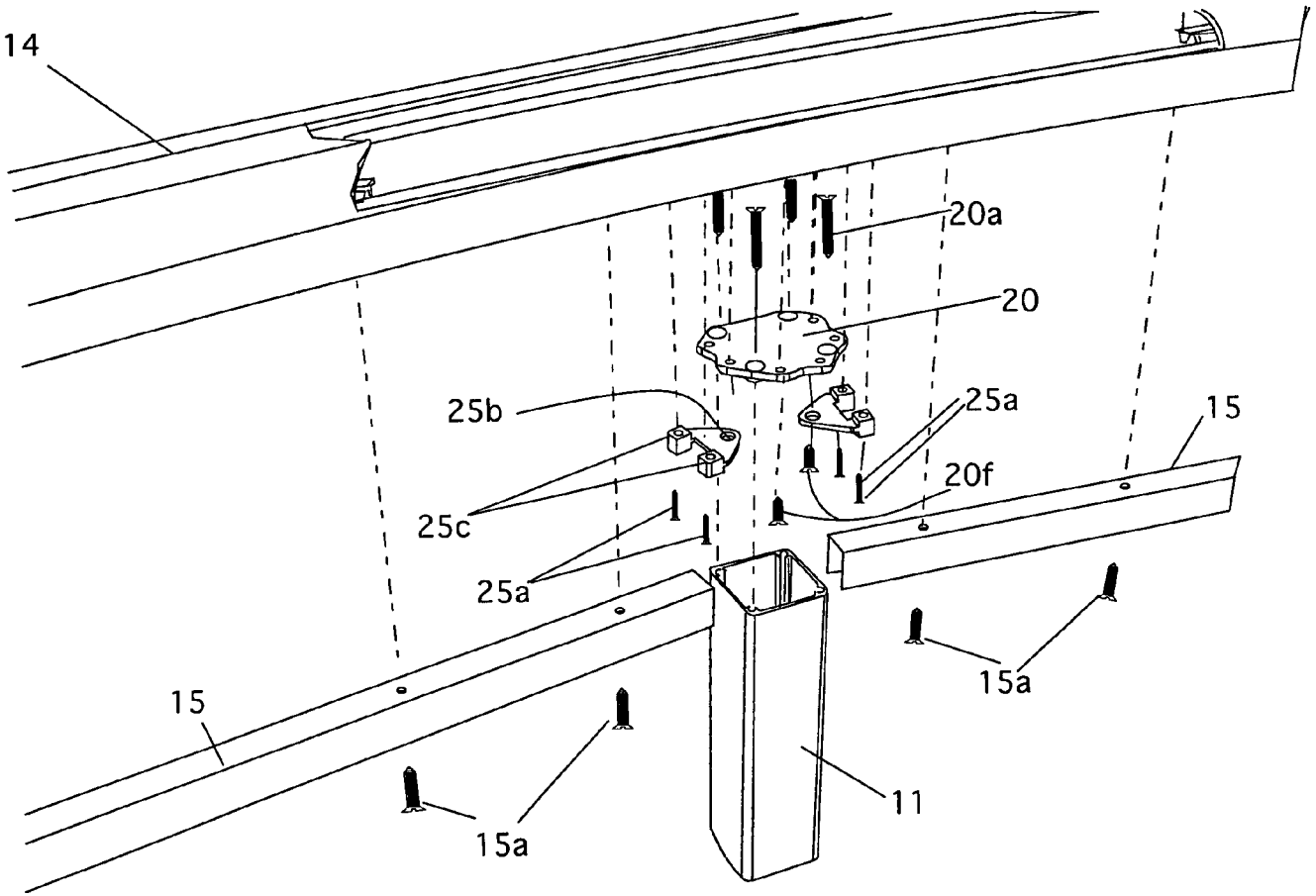
FIG. 4 is a partially exploded view of a section of the rail showing the post cap assembly.

FIG. 4 is a partially exploded detail view of a section of the rail showing details of the post cap 20. As in FIG. 3, the top rail 14 is shown positioned above the other railing components. A vertical post 11 is positioned as discussed above. Two lengths of glass channel 15 are shown on either side of the vertical post 11. Note the screws 15*a* that secure the glass channels 15 to the top rail 14. As mentioned above, the post cap 20 is secured to the vertical post by screws 20*a*. Note that the particular shape of the post cap is discussed in detail below. Note also that the post cap is secured to the top rail by screws 20*f* as discussed below.

Here, the articulating mounting brackets 25 are shown clearly. They are secured to the top rail by screws 25*a*. The articulating mounting brackets 25 have a generally triangular shape with a hole 25*b* at the apex of the triangle and two mounting block 25*c* at the base corners. The hole 25*b* is positioned on a pivot point on the post cap 20 as discussed below.

The mounting blocks 25*c* have a dual purpose. First, they secure the top rail with the screws 25*a*. Second, they form a channel in which the glass channel rests. In this way, the glass channels are positioned and strengthened. Moreover, because the articulating mounting brackets 25 can pivot around the mounting hole 25*b*, the glass channels can be easily adjusted in the proper position without having to make intricate and precise miter cuts.

Figure 5:
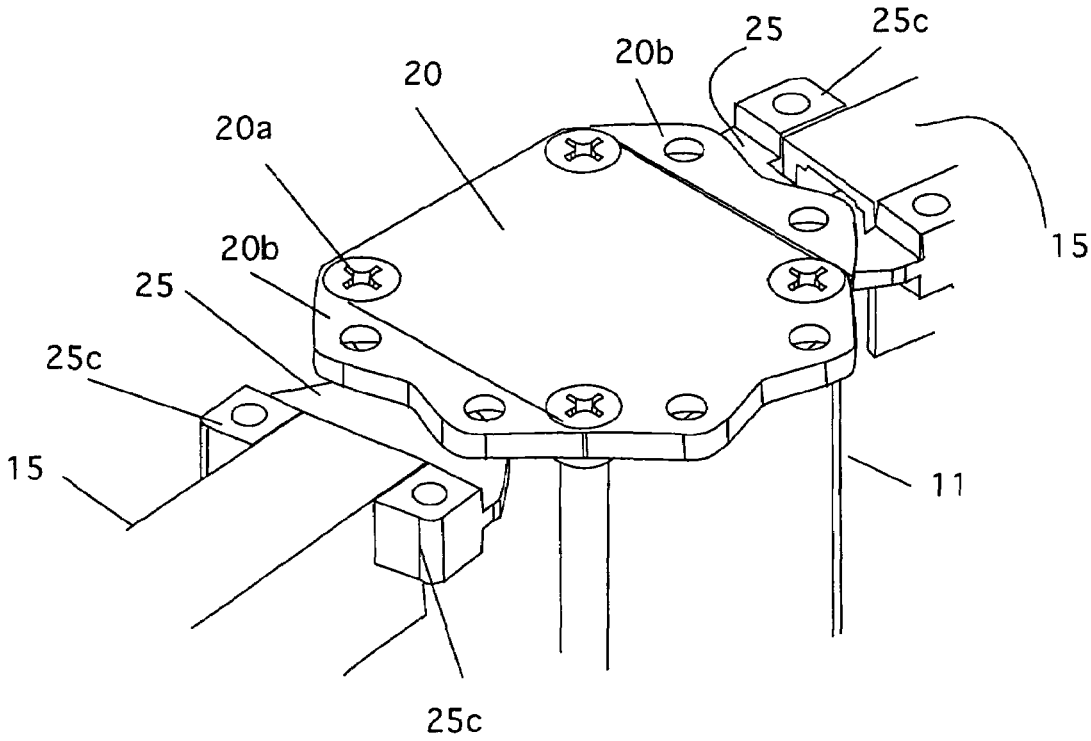
FIG. 5 is a detail view of an assembled in-line post.

FIG. 5 is a detail view of an assembled in-line post. In this figure, the vertical post 11 is shown at the bottom of the assembly. The post cap 20 is shown secured to the vertical post with the screws 20*a*. The articulating mounting brackets 25 are shown positioned on the post cap 20 and the glass channels 15 are shown positioned between the mounting blocks 25*c*.

Figure 6:
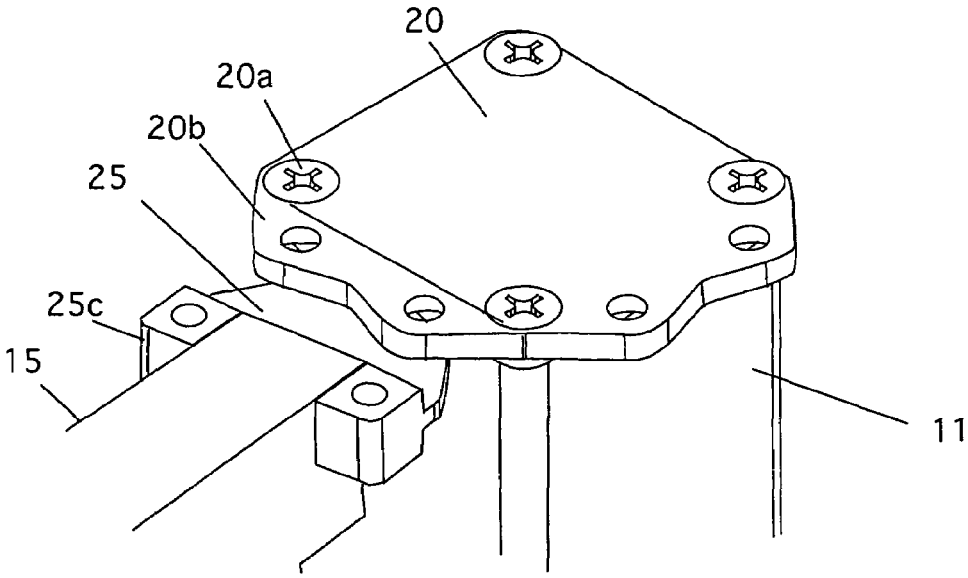
FIG. 6 is a detail of an assembled end post.

FIG. 6 is a detail of an assembled end post. Here, the railing reaches an end. There is only one length of glass rail 15 extending out from the vertical post 11. The post cap 20 is attached to the vertical post with screws 20*a* as before. Note, however, that the post cap 20 has been modified. As discussed below, the post caps have two flanges 20*b*. These flanges can be cut off as needed. Thus, in FIG. 6, one of the flanges has been removed to present a 90-degree corner for the end of the railing. As before, an articulating mounting bracket 25 is shown positioned on the post cap 20 and the glass channel 15 is shown positioned between the mounting blocks 25*c*. Of course, for an end installation, only one articulating mounting bracket 25 is needed.

Figure 7:
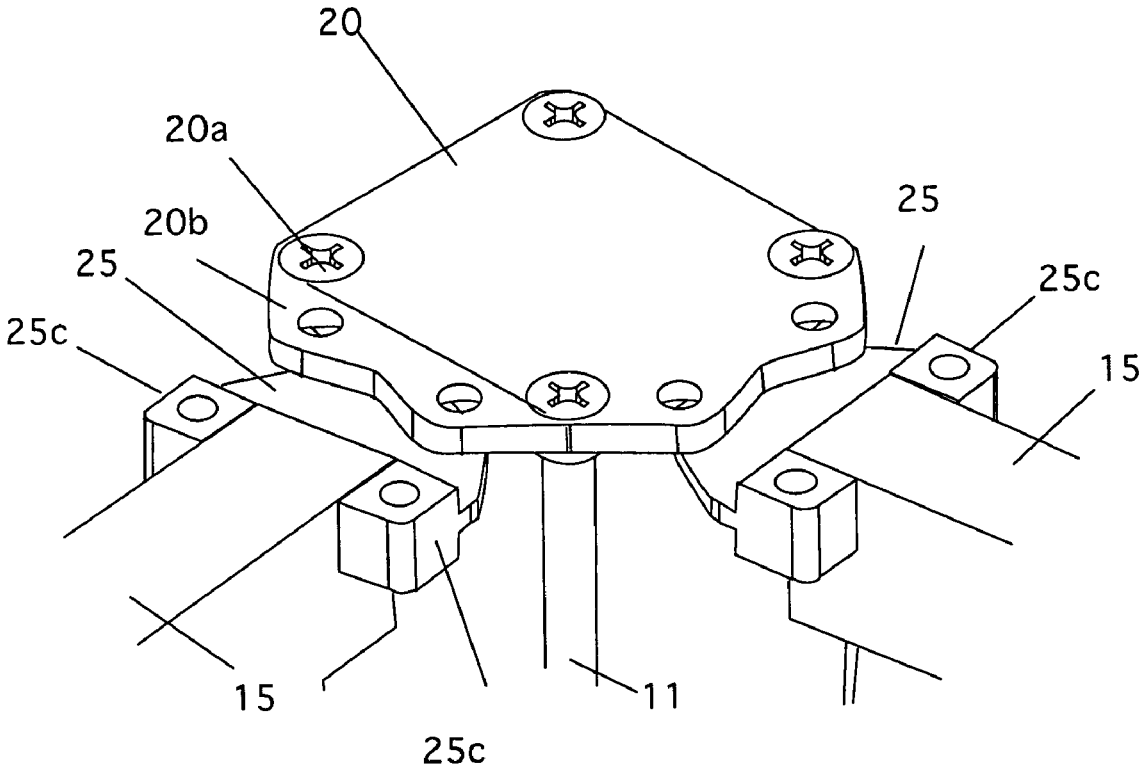
FIG. 7 is a detail view of an assembled corner post.

FIG. 7 is a detail view of an assembled corner post. In this figure, the post cap 20 is again shown with one flange 20*b* removed. Note that the articulating mounting brackets 25 are shown positioned on the post cap 20 at right angles, to make the corner. As before, the glass channels 15 are shown positioned between the mounting blocks 25*c* of the articulating mounting brackets 25.

FIGS. 5, 6 and 7 show the versatility of this system. Using only a few components, any configuration and angular setup (within reasonable design parameters) can be achieved easily and quickly with a minimum of field installation labor.

Figure 8:
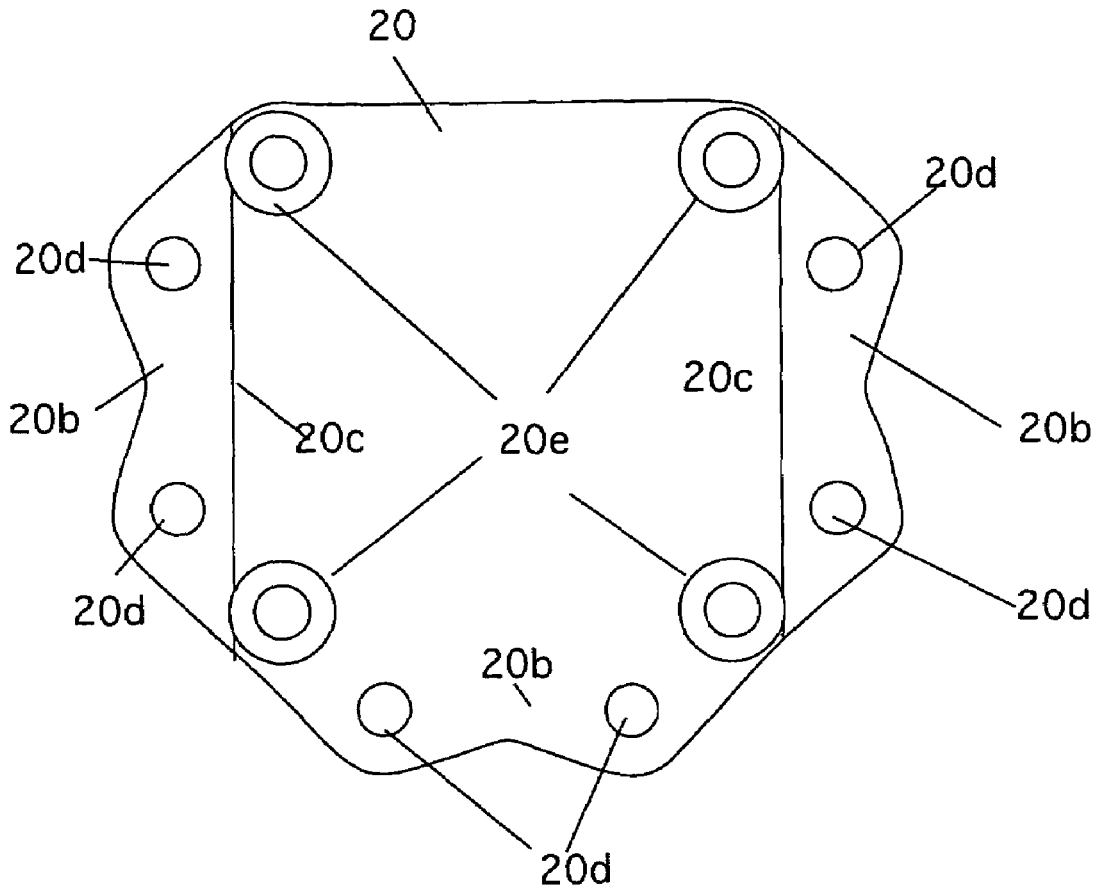
FIG. 8 is a top view of a post cap.

FIGS. 8-12 show details of the post cap 20. FIG. 8 is a top view of a post cap 20. The post cap has a formed shape as shown. On three sides, there are mounting flanges 20*b*. On two of the side, cast-in cutting guides 20*c* are shown. As discussed above, these cutting guides are used to make end and corner post caps in the field. On each of the mounting flanges, are mounting holes 20*d*. These holes are used to secure the post cap to the top rail with screws 20*f*. See e.g., FIG. 4.

The post caps 20 have four countersunk mounting holes 20*e* that are used to secure the post cap to the vertical posts 11.

Figure 9:
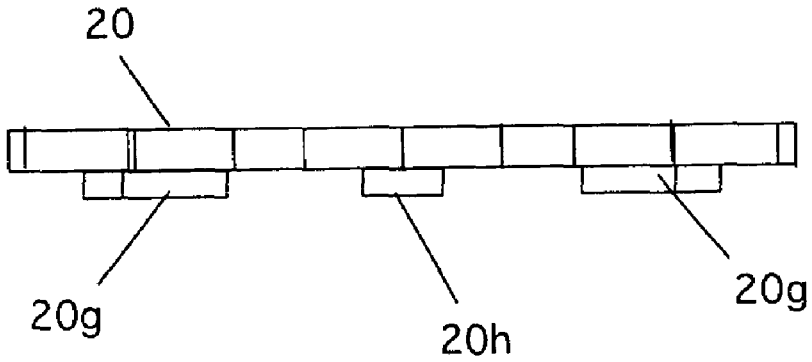
FIG. 9 is a side view of a post cap.

FIG. 9 is a side view of a post cap. Note that the top of the post cap is flat. The countersunk mounting holes 20*e* are shown extending downward from the bottom of the post cap to form spacers 20*g*. Note also, the pivot point 20*h* that also extends below the bottom surface of the post cap. The pivot points are used to hold the articulating mounting bracket 25 at hole 25*b*.

Figure 10:
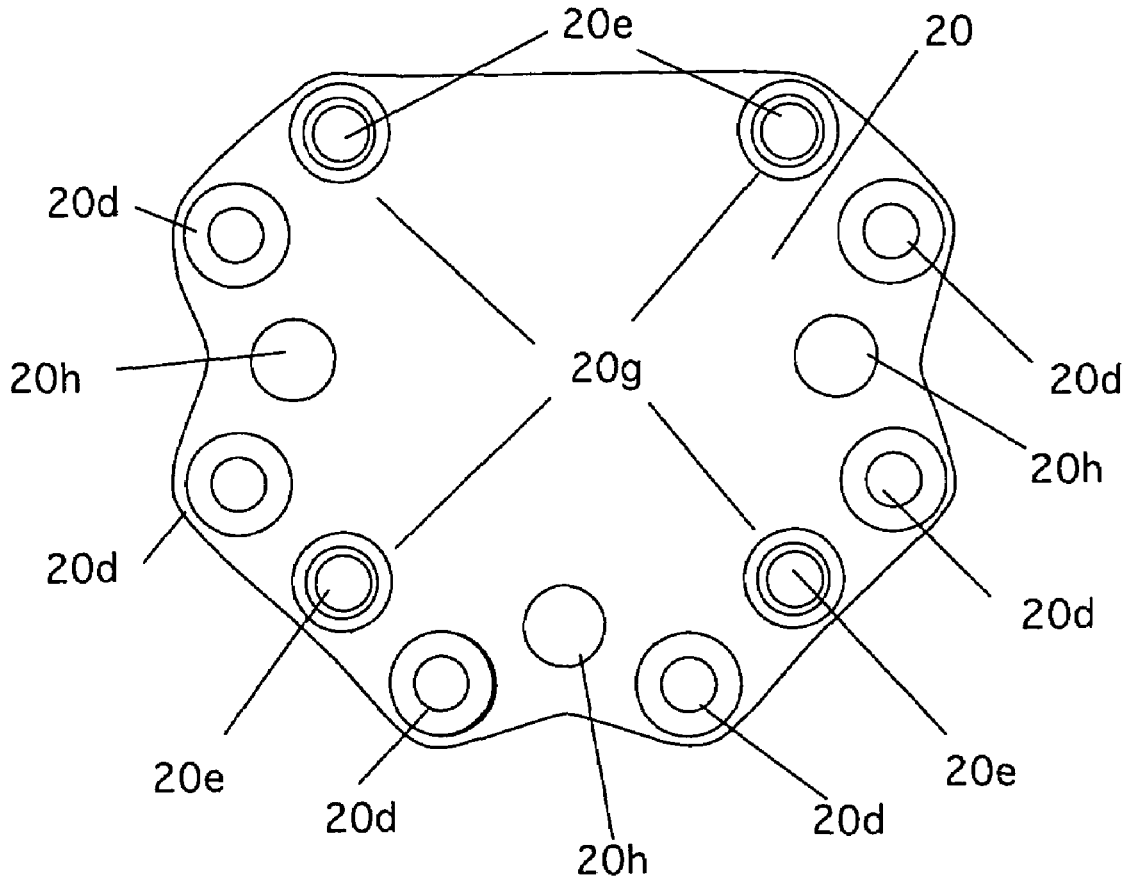
FIG. 10 is a bottom view of a post cap.

FIG. 10 is a bottom view of a post cap. Once again, the spacers 20*g* are shown as well as the countersunk holes 20*d*, and the pivot points 20*h*.

Figure 11:
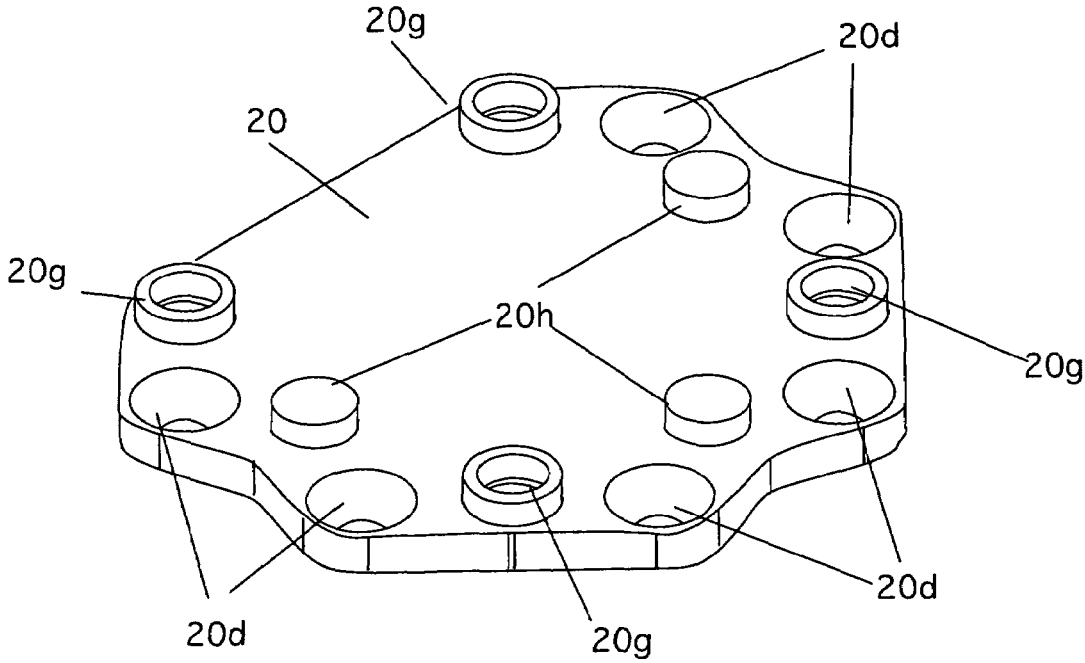
FIG. 11 is a bottom perspective view of a post cap.

FIG. 11 is a bottom perspective view of a post cap. The mounting holes 20*d* and the spacers 20*g* are shown as well as the countersunk holes 20*d*, and the pivot points 20*h*.

Figure 12:
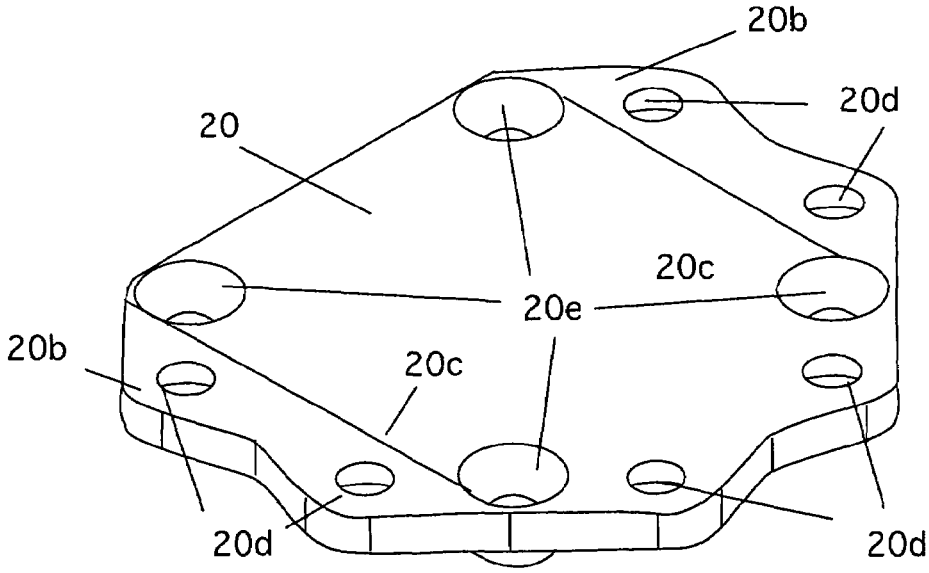
FIG. 12 is a top perspective view of a post cap.

FIG. 12 is a top perspective view of a post cap. Here again, the mounting holes 20*d* and mounting holes 20*e* are shown as well as the cut lines 20*c*.

Figure 13:
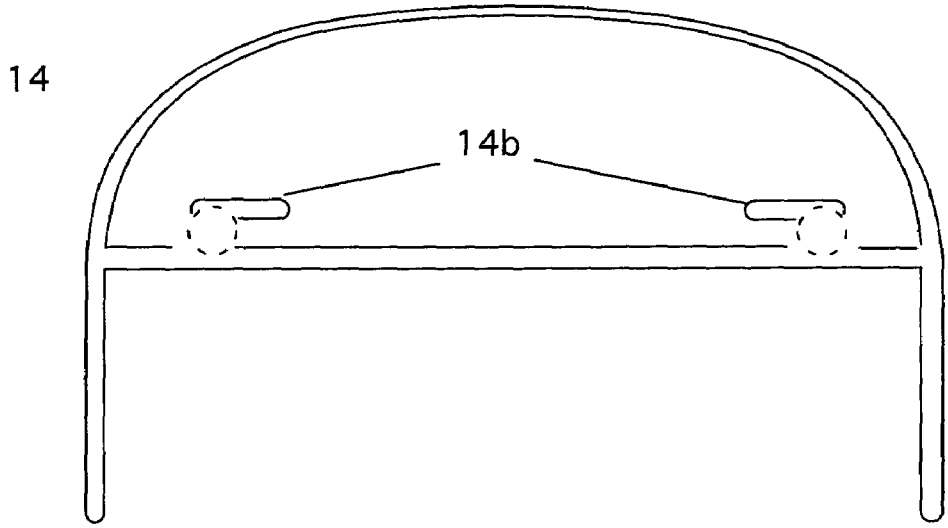
FIG. 13 is a cross-sectional view of the top rail.

FIG. 13 is a cross-sectional view of the top rail. In this figure, the top rail 14 is shown. Within the top rail is a mounting plate 14*b* that is used to attach the glass channels 15.

Figure 14:
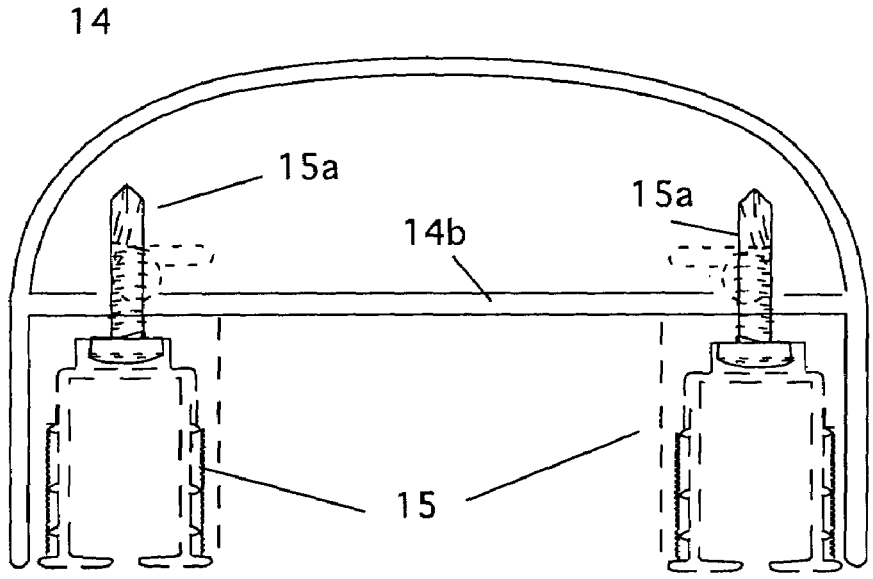
FIG. 14 is a cross sectional view of a top rail showing full potential range of glass channel positions.

FIG. 14 is a cross sectional view of a top rail showing glass channels installed. In this view, the glass channels 15 are shown secured to the top rail using the screws 15*a*. Note that two glass channels are shown. In actuality, only one glass channel is used. This figures illustrates the widest range of positions that the glass channel takes as the lower unit is built to support the curved top rail. See FIG. 2, which also shows the ranges of positions of the glass channel under the top rail as the curve progresses. In the preferred embodiment, the widest spacing of the glass channels is 3.070 inches on center.

Figure 15:
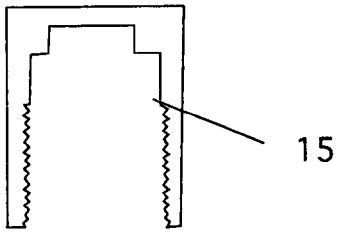
FIG. 15 is a cross-sectional view of a glass channel.

FIG. 15 is a cross sectional view of a glass channel 15

Figure 16:
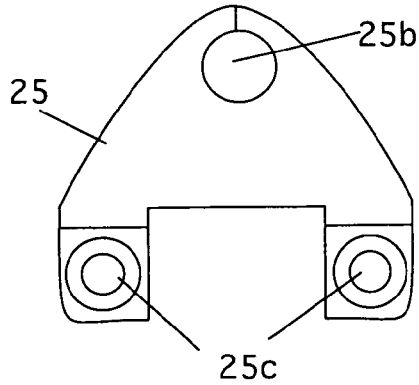
FIG. 16 is a bottom view of an articulating bracket.

FIG. 16 is a bottom view of an articulating bracket. Here, the mounting hole 25*b* and mounting blocks 25*c* are shown.

Figure 17:
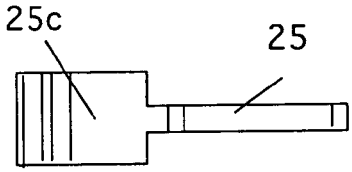
FIG. 17 is a side view of an articulating bracket.

FIG. 17 is a side view of an articulating bracket. Here, the mounting blocks 25*c* are shown extending above and below the man body of the triangular articulating bracket. This not only provides additional support for the mounting screws, it also adds substance to better support the glass channels that fit between them.

Figure 18:
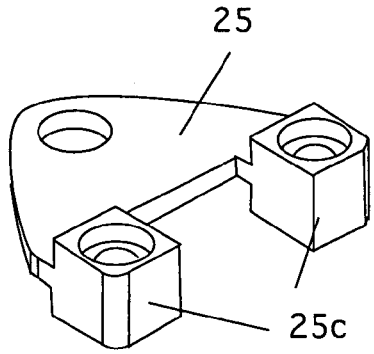
FIG. 18 is a bottom perspective view of an articulating bracket.

FIG. 18 is a bottom perspective view of an articulating bracket. Note that in this view, the mounting holes are counter sunk.

Figure 19:
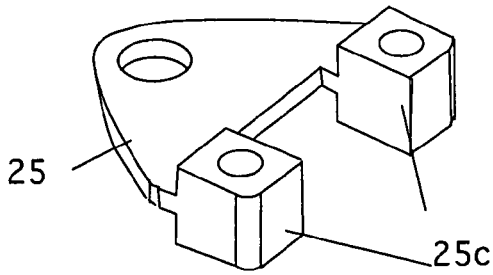
FIG. 19 is a top perspective view of an articulating bracket.

FIG. 19 is a top perspective view of an articulating bracket.

Figure 20:
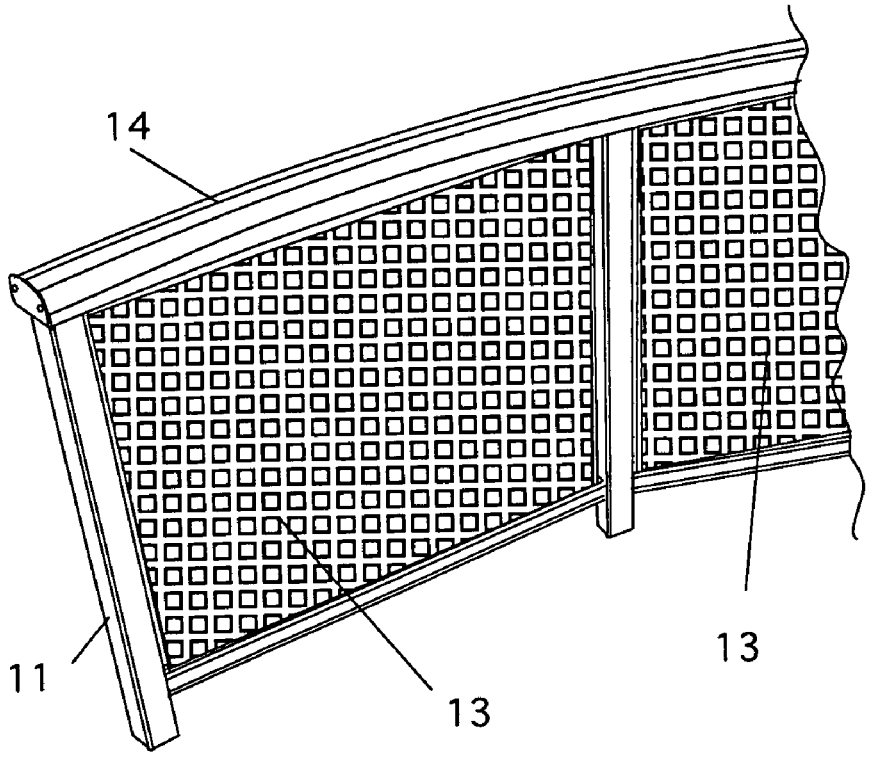
FIG. 20 is a detail of an infill panel made of perforated metal panels.

FIG. 20 is a detail of an infill panel made of perforated panels. In this figure, the infill panels 13 are shown as perforated panels. These can be either metal or plastic, as desired.

Figure 21:
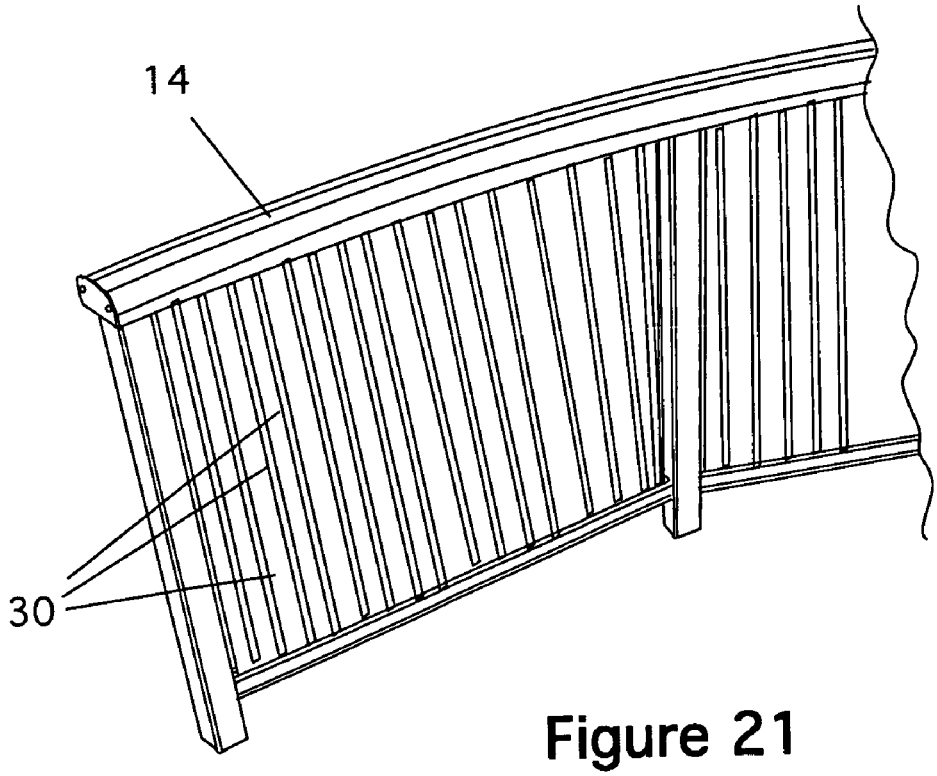
FIG. 21 is a detail of an infill panel made of vertical pickets.

FIG. 21 is a detail of an infill panel made of vertical pickets. Here, a number of vertical pickets 30 are shown. The pickets 30 are used in place of a solid infill panel. Although the pickets shown are simple vertical pickets, any other style of pickets may be used.

Figure 22:
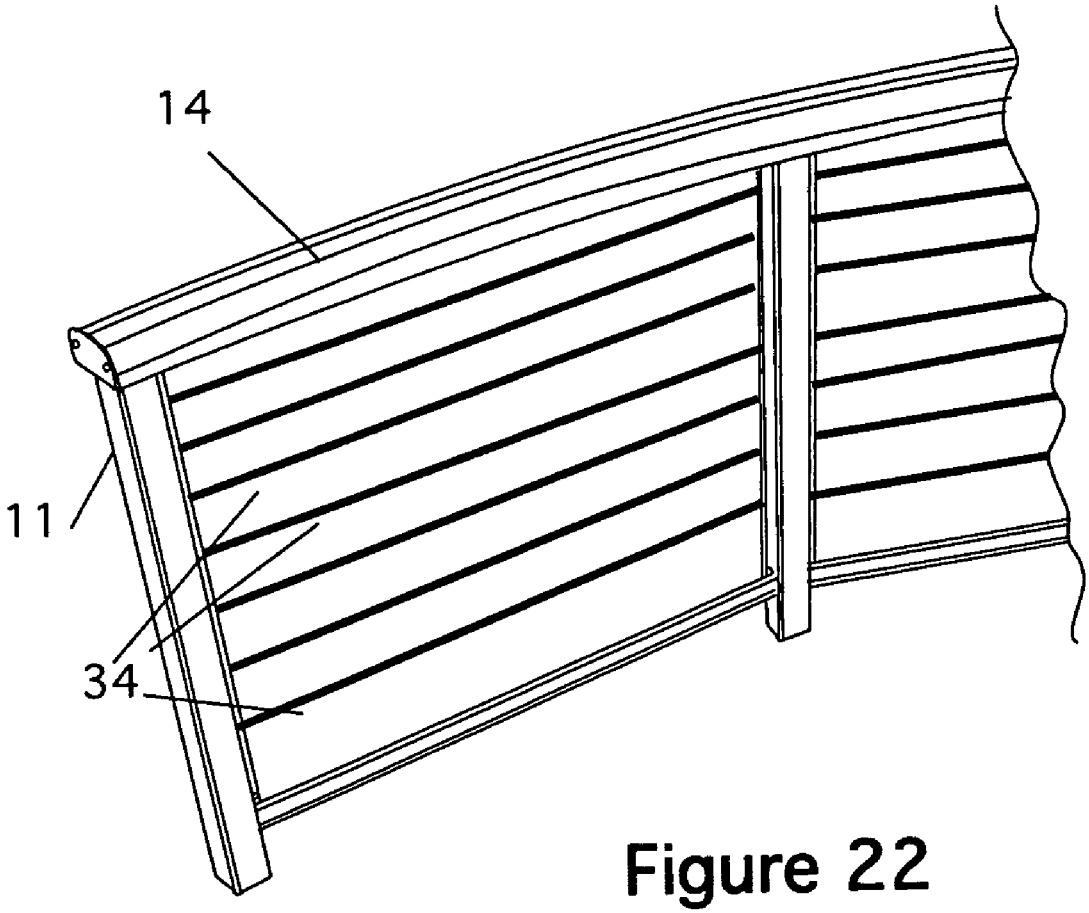
FIG. 22 is a detail of an infill panel made of cables.

Finally, FIG. 22 shows cables 34 run between the posts in lieu of a panel.

It is possible to use many different materials and styles for the infill panels and the figures shown are not meant to be exclusive or limiting.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A railing system comprising:

a) a plurality of posts, said plurality of posts being spaced apart and being positioned on a line representing a desired curve about a point of curvature;

b) a plurality of post caps, one of said plurality of post caps being attached to one of said plurality of posts;

c) a plurality of glass channels, each of said glass channels having a width and a top, one of said plurality of glass channels being positioned between two of said plurality of post caps and a plurality of infill panels positioned within said glass channels and between two of said plurality of posts;

d) a means for aligning each of said plurality of glass channels between said plurality of post caps, said means for aligning having a width and being pivotably attached to said plurality of post caps; and e) a continuous curved top rail, wherein said curved top rail and said line share a common radius with respect to said point of curvature, said radius being perpendicular to said posts, said curved top rail also having a slot formed therein, being positioned on said plurality of glass channels and said plurality of posts, and being secured thereto such that the tops of said plurality of glass channels and said post caps are concealed within said slot of said curved top rail.

2. The railing system of claim 1 wherein the means for aligning each of said plurality of glass channels comprises a plurality of articulating brackets, each of said articulating brackets having a length and a width, and further wherein the length of each of said articulating brackets is in generally longitudinal alignment with said glass channels and further wherein the width of said articulating brackets is in generally perpendicular alignment with said glass channels and further wherein the width of said articulating brackets being greater than its length.

3. The railing system of claim 2 wherein each of said plurality of articulating brackets has a pair of mounting blocks formed thereon.

4. The railing system of claim 2 wherein each of said plurality of articulating brackets has a generally triangular form.

5. The railing system of claim 1 wherein said plurality of posts comprise a first end vertical post, a plurality of intermediate line posts and a second end post, all of said posts being spaced apart and being positioned on said line representing a desired curve.

6. The railing system of claim 5 wherein the first and second end posts have a single means for aligning pivotably attached to said post caps.

7. The railing system of claim 5 wherein the plurality of intermediate line posts each have a pair of means for aligning pivotably attached to said post caps, said pair of means for aligning being oppositely disposed on said post caps.

8. The railing system of claim 1 wherein each of said plurality of posts has a plurality of mounting holes formed thereon.

9. The railing system of claim 1 wherein each of said plurality of post caps has a plurality of mounting holes formed thereon.

10. The railing system of claim 1 wherein each of said plurality of post caps has at least one cut-line indicator mark.

11. A railing system comprising:

a) a plurality of posts, said plurality of posts being spaced apart and being positioned on a line representing a desired curve about a point of curvature, and further wherein said plurality of posts whereby said plurality of posts including a first end post, a second end post and a plurality of intermediate posts;

b) a plurality of post caps, one of said plurality of post caps being attached to one of said plurality of posts;

c) a plurality of glass channels having a width, one of said plurality of glass channels being positioned between two of said plurality of post caps and a plurality of infill panels positioned within said glass channels and between two of said plurality of posts;

d) a plurality of articulating brackets pivotably attached to the post caps and being distributed as follows: a single articulating bracket attached to the post cap attached to the first end post, a pair of articulating brackets attached to each of said plurality of intermediate posts and a single articulating bracket attached to the post cap attached to the second end post;

e) a continuous curved top rail, wherein said curved top rail and said line share a common radius with respect to said point of curvature, said radius being perpendicular to said posts, and a slot formed therein, being positioned on said plurality of glass channels and said plurality of posts, and being secured thereto such that the tops of said plurality of glass channels and said post caps are concealed within said slot of said curved top rail; and f) a means for securing said curved top rail to said plurality of glass channels.

12. The railing system of claim 11 further comprising a means for securing said curved top rail to said plurality of post caps.

13. The railing system of claim 11 wherein each of said plurality of articulating brackets has a pair of mounting blocks formed thereon.

14. The railing system of claim 11 wherein each of said plurality of articulating brackets has a generally triangular form.

15. The railing system of claim 11 wherein each of said plurality of post caps has a plurality of mounting holes formed thereon.

16. The railing system of claim 11 wherein each of said plurality of post caps has at least one cut-line indicator mark.

17. The railing system of claim 11 wherein each of said plurality of post caps has a pair of oppositely disposed removable cut flanges thereon.

18. The railing system of claim 17 wherein the post caps on said first and second end posts have one cut flanged removed.

19. The railing system of claim 1 wherein the plurality of infill panels is selected from the group of glass, solid panels of metal, perforated metal panels, vertical pickets and cables.

20. The railing system of claim 11 wherein the plurality of infill panels is selected from the group of: glass, solid panels of metal, perforated metal panels, vertical pickets and cables.

* * * * *